US006513965B2

(12) United States Patent
Hasberg et al.

(10) Patent No.: US 6,513,965 B2
(45) Date of Patent: Feb. 4, 2003

(54) APPARATUS FOR MANUFACTURING PHOTOGRAPHIC EMULSIONS

(75) Inventors: Dirk J. Hasberg, Rochester, NY (US); Rajesh V. Mehta, Rochester, NY (US); Michael Bryan, Watford (GB); Ramesh Jagannathan, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/992,512

(22) Filed: Nov. 6, 2001

(65) Prior Publication Data

US 2002/0101782 A1 Aug. 1, 2002

Related U.S. Application Data

(62) Division of application No. 09/738,734, filed on Dec. 15, 2000.

(51) Int. Cl.[7] ..... B01F 15/00

(52) U.S. Cl. ..... 366/168.1; 366/172.1; 366/173.1; 366/172.2; 366/175.2

(58) Field of Search ..... 366/169.1, 168.1, 366/172.1, 172.2, 174.1, 175.2, 173.1, 178.1, 181.5, 262, 315; 422/225

(56) References Cited

U.S. PATENT DOCUMENTS

| | | | | | |
|---|---|---|---|---|---|
| 2,641,453 | A | * | 6/1953 | Teale | 366/178.1 |
| 3,186,803 | A | * | 6/1965 | Akaboshi et al. | 366/172.2 |
| 3,415,650 | A | | 12/1968 | Frame et al. | |
| 3,692,283 | A | | 9/1972 | Sauer et al. | |
| 3,744,763 | A | * | 7/1973 | Schnoring et al. | 366/178.1 |
| 3,773,302 | A | * | 11/1973 | Johnson et al. | 366/172.2 |
| 3,801,326 | A | * | 4/1974 | Claes | 430/569 |
| 4,096,587 | A | * | 6/1978 | Haller | 366/169.1 |
| 4,147,551 | A | | 4/1979 | Finnicum et al. | |
| 4,289,733 | A | | 9/1981 | Saito et al. | |
| 4,335,199 | A | | 6/1982 | Michewich et al. | |
| 4,399,215 | A | | 8/1983 | Wey | |
| 4,539,290 | A | | 9/1985 | Mumaw | |
| 4,666,669 | A | | 5/1987 | Mumaw | |
| 4,999,131 | A | * | 3/1991 | Shimizu et al. | 366/168.1 |
| 5,018,871 | A | * | 5/1991 | Brazelton et al. | 366/169.1 |
| 5,035,991 | A | | 7/1991 | Ichikawa et al. | |
| 5,096,690 | A | | 3/1992 | Saito | |

(List continued on next page.)

FOREIGN PATENT DOCUMENTS

| | | |
|---|---|---|
| EP | 0 137 398 B1 | 5/1990 |
| EP | 0 532 842 B1 | 1/1991 |
| WO | WO 92/21061 | 11/1992 |

OTHER PUBLICATIONS

O. Levenspiel "Chemical Reaction Engineering", 2nd Edition, Chapter 9, pp. 257–260.

*Primary Examiner*—Tony G. Soohoo
(74) *Attorney, Agent, or Firm*—Mark G. Bocchetti

(57) ABSTRACT

An apparatus and method for mixing at least two reactants is taught wherein a first reactant is delivered to a reaction zone through a first annular flow path and a second reactant is delivered to the reaction zone through a second annular flow path. The first and second annular flow paths are concentric with one another and the two reactants intermix with one another in the reaction zone. There is a rotating disc having a surface, defining one boundary of the reaction zone. The flow of the first and second reactants across the rotating disc and through the reaction zone is generally radial and has a residence time in the reaction zone of not more than about 100 msec, and preferably not more than about 50 msec. The reaction zone resides in a main reactor vessel and there is a driven agitator residing in the main reactor vessel to stir the contents thereof.

11 Claims, 4 Drawing Sheets

U.S. PATENT DOCUMENTS 5,104,785 A 4/1992 Ichikawa et al.
5,145,768 A 9/1992 Ichikawa et al.
5,202,226 A 4/1993 Saitou
5,219,720 A 6/1993 Black et al.
5,238,805 A 8/1993 Saitou
5,334,359 A 8/1994 Masutomi et al.
5,549,879 A 8/1996 Chow
5,690,428 A * 11/1997 Bryan et al. ..... 366/172.1
6,431,742 B2 * 8/2002 Mori et al. ..... 366/172.1
6,435,707 B1 * 8/2002 Mori et al. ..... 366/172.1
6,443,611 B1 * 9/2002 Hasberg et al. ..... 366/172.1

* cited by examiner

APPARATUS FOR MANUFACTURING PHOTOGRAPHIC EMULSIONS

CROSS-REFERENCE TO RELATED APPLICATIONS

This is a divisional of application Ser. No. 09/738,734, filed December 15, 2000.

FIELD OF THE INVENTION

This invention relates to mixing apparatus for intermixing two or more reactants and, more particularly, to mixing apparatus for manufacturing photographic emulsions.

BACKGROUND OF THE INVENTION

Most state-of-the-art manufacturing processes used in the photographic industry expose emulsion grains to local high concentrations of silver nitrate in the vicinity of the silver nitrate reagent introduction pipes. (See for example U.S. Pat. No. 3,415,650, U.S. Pat. No. 3,692,283, U.S. Pat. No. 4,289,733, U.S. Pat. No. 4,666,669, U.S. Pat. No. 5,096,690, U.S. Pat. No. 5,238,805). Such exposure is undesirable because of the uncontrolled amount of reduced silver centers that may be created on the grain surface. The variable amount of reduced silver centers lead to variability in photographic sensitivity of the emulsions, which is undesirable.

In processes where an additional mixing vessel is used to mix silver nitrate with alkali halide prior to introducing them as fine silver halide grains into the reaction vessel (see for example U.S. Pat. No. 5,145,768 and U.S. Pat. No. 5,334,359), such an exposure is avoided but, additional complexities are created related to the additional mixing vessel and transport of material from that additional mixing vessel to the reaction vessel. When the mixing vessel is separate from and positioned externally to the main reaction vessel, problems arise due to the growth of fine grains during the solution delivery from the mixing vessel to the main reaction vessel. Such a process usually does not meet the requirement of grain formation in a time period as short as realized in the conventional method. When the mixing vessel is immersed in the reaction vessel, the above problem is apparently solved only when a separate heavy duty mechanical stirrer is provided near the discharge slit of the mixing vessel for immediate uniform mixing of the discharged solution with the reaction mixture. It is, however, well known that a well stirred mixing vessel has an exponential distribution of residence times (cf O. Levenspiel, Chemical Reaction Engineering, 2nd Edition, Chapter 9). Therefore, a small fraction of discharge fluid bypasses the mixing process inside the mixing vessel and microscopic pockets of high concentration silver nitrate solution are expected to be discharged into the reaction vessel. Furthermore, when the discharge fluid meets the reaction mixture in the space between the two heavy duty mechanical stirrers, the mixing intensity is lower than that near the stirrer blades, so the pockets of high concentration silver nitrate solution are not immediately eliminated. Also, the discharge slit of the mixing vessel has to be provided with a back flow preventing valve to prevent reaction mixture from flowing into the mixing vessel, providing yet another operational complexity in a manufacturing environment.

U.S. Pat. No. 5,690,428 to Bryan et al. teaches a mixing device that includes concentric tubes for supplying solutions to a mixing rotor. The mixing rotor in combination with the supply tubes creates a non-planar, annular reaction zone that includes step changes in diameter thereof, and therefore, multiple turns in the flow path through the reaction zone.

There is continuing need for manufacturing high sensitivity photographic emulsions with tightly controlled sensitivities. Since prior art mixing apparatus subject emulsion grains to variable high concentrations of silver nitrate in the reaction vessel, tight control of sensitivity of the emulsion being manufactured is difficult. In prior art processes where the emulsion grains are not exposed to high concentrations of silver nitrate, the problem is either that of longer grain formation time than the conventional process, or that of increased operational complexity of the manufacturing process, resulting from the placement of at least two separate heavy duty mechanical stirrers in close proximity of each other.

SUMMARY OF THE INVENTION

It is therefore an object of the present invention to provide an apparatus for mixing two or more reactants which provides a very short residence time in the apparatus.

It is a further object of the present invention to provide an apparatus for mixing two or more reactants which obviates any back flow in the apparatus.

Yet another object of the present invention is to provide an apparatus for mixing two or more reactants which prevents the formation of short-circuiting flow paths therethrough.

Still another object of the present invention is to provide an apparatus for mixing two or more reactants which prevents the formation of dead flow pockets therein.

Briefly stated, the foregoing and numerous other features, objects and advantages of the present invention will become readily apparent upon a review of the detailed description, claims and drawings set forth herein. These features, objects and advantages are accomplished by forming a mixing apparatus that includes a generally planar reaction zone inside the main reaction vessel such that the reaction mixture contained in the main reaction vessel never backflows into the planar reaction zone. The invention accomplishes efficient mixing inside the reaction zone, as well as efficient mixing of the reaction products produced in the reaction zone with the reaction mixture in the main reaction vessel. Within the planar reaction zone, the two reactants are mixed and reacted. The reaction products exit the reaction zone directly into the reaction mixture contained in the main reaction vessel. There is no connecting or intermediate flow path. In other Words, there is a direct interface between the reaction zone and the reaction mixture contained in the main reaction vessel. In the production of photographic emulsions, silver nitrate and alkali halide solutions are mixed and reacted such that they are converted into the fine silver halide grains by the time they leave the generally planar reaction zone and mix with the reaction mixture. The generally planar reaction zone includes a rotating disc which defines one surface or boundary of the generally planar reaction zone. The two reactants are directed in separate and concentric annular flow paths at the substantially planar surface of a rotating disc. In the production of photographic emulsions, silver nitrate and alkali halide solutions are directed in separate and concentric annular flow paths at the planar surface of a rotating disc. The rotating disc aids in the mixing of the silver nitrate and alkali halide solutions. Further, the rotating disc may act, at least partially, as a pump impeller accelerating the reacting silver nitrate and alkali halide solutions toward the perimeter of the rotating disc in a generally radial or spiral flow path through the generally planar reaction zone. The rotating disc should provide enough pumping to at least overcome head losses resulting from the flow of the liquid through the reaction zone. This, in combination with the flow rates and pressures of the two reactants, and the generally planar reaction zone, ensures that there is no back flow of the silver nitrate and alkali halide solutions in the generally planar reaction zone. In other words, the rotating disc, the flow rates and pressures of the two reactants, and the geometry of the reaction zone obviate the formation of stagnant pockets in the planar reaction zone. As the reacted silver nitrate and alkali halide solutions exit the reaction zone, they immediately mix with the reaction mixture in the main reaction vessel. Through the control of the pressure and flow rates of the silver nitrate and alkali halide solutions into and through the reaction zone, and disc rotation, backward mixing of the reaction mixture from the main reaction vessel into the planar reaction zone is prevented. The residence time of the fluid in the reaction chamber is so small that the fine grains that are generated are ejected into the main reaction vessel very quickly after the formation thereof. Thus the present invention avoids exposure of emulsion grains in the main reaction vessel to high concentrations of silver nitrate without introducing complexities of the prior art where two stirrers have to be placed in close proximity. In general, the planar reaction zone is advantageous because it produces a more uniform distribution of fine grains, which can be used to produce a narrower distribution of silver halide emulsion grains. The uniformity of flow-field also improves the scalability of the precipitation process. Thus, the present invention solves the problems encountered with the prior art processes and apparatus and enables manufacturing of high sensitivity photographic emulsions with tightly controlled sensitivities.

The present invention is being described herein with specific relationship to the mixing into the main reaction vessel of reacted silver nitrate and alkali halide solutions to form radiation-sensitive emulsions, specifically, silver halide emulsion grains. However, those skilled in the art will recognize that this invention may be applicable to any precipitation process that produces particles of sparingly soluble materials. For example, the apparatus of the present invention may be used for gold or silver chalcogenides.

DETAILED DESCRIPTION OF THE INVENTION

Figure 1:
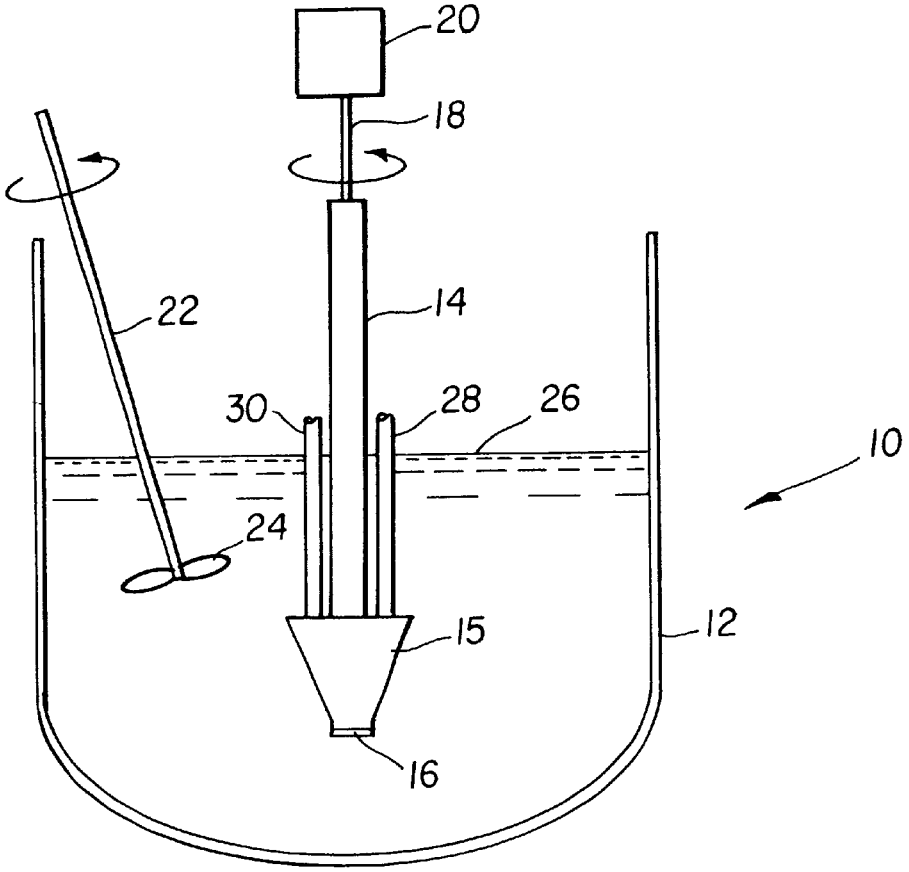
FIG. 1 is a schematic of the reactor and mixing apparatus of the present invention.

Turning first to FIG. 1, the mixing apparatus 10 of the present invention is schematically illustrated. Such mixing apparatus 10 is particularly suited for making silver halide grains. The apparatus 10 includes the reaction vessel 12. Extending down into the reaction vessel 12 is a reactor support 14. Supported from reactor support 14 are reactor manifold 15 and reactor 16. Rotatably residing within reactor support 14 is shaft 18, rotation of which is driven by motor 20. A separate mechanical mixing device is used to stirrer contents of the reaction vessel 12. A shaft 22 of the mechanical mixing device has an agitating blade 24 attached to an end thereof, such that the agitating blade 24 resides below the liquid level 26 in reaction vessel 12. The mixing apparatus 10 of the present invention, when used for producing silver halide emulsions, has at least water and a dispersion medium contained in the main reaction vessel 12. The dispersion medium may include pre-made silver halide grains. A pair of conduits 28, 30 provide for separate flow of the two reactants to the reactor manifold 15 and a reactor 16. In the production of silver halide grains, an aqueous silver salt solution and an aqueous halide salt solution (either or both solutions may contain a peptizer) are delivered to the reactor manifold 15 through conduits 28, 30. The silver nitrate or alkali halide solutions may contain dissolved gelatin for specific photographic emulsions when necessary.

Figure 2:
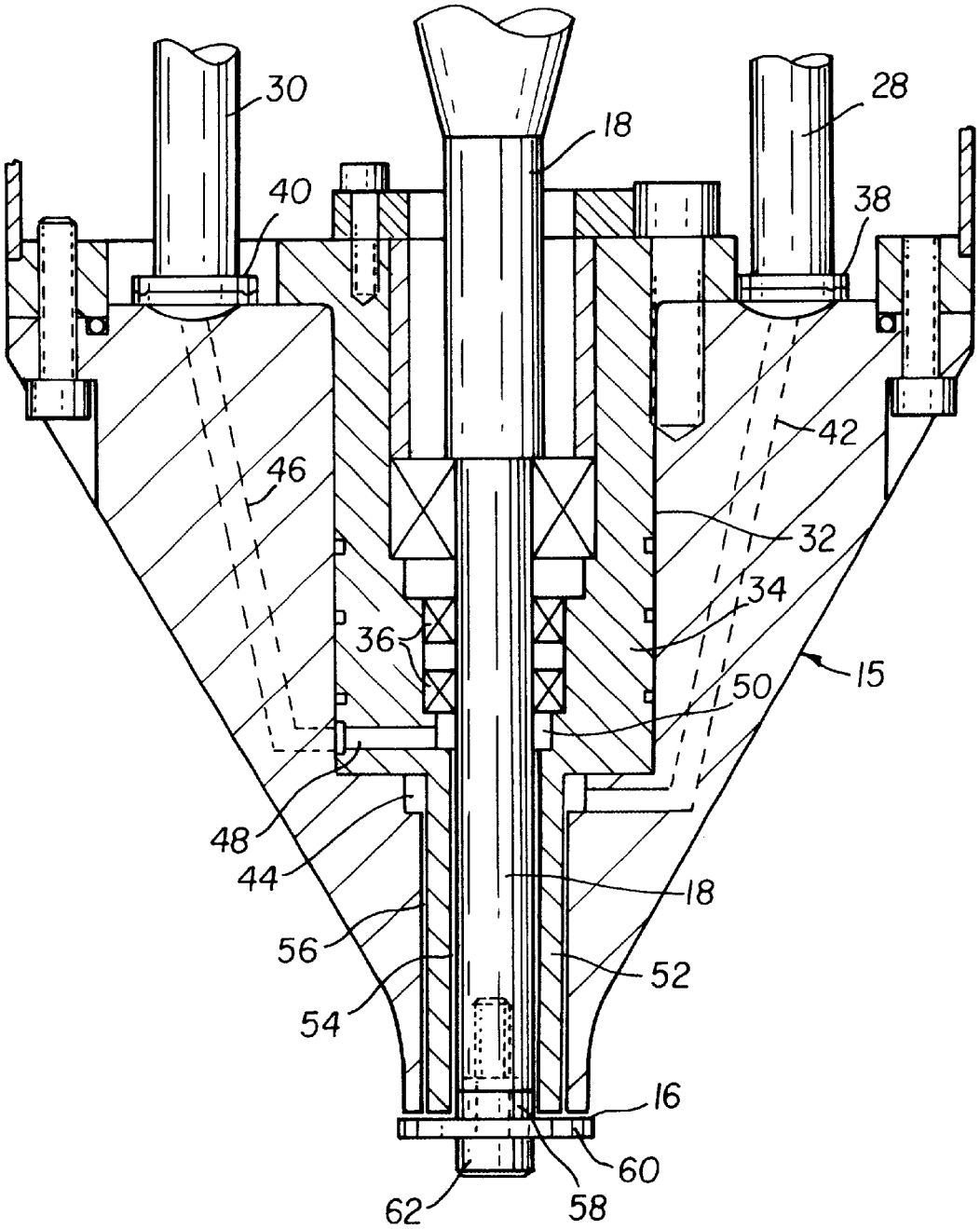
FIG. 2 is a cross-sectional view of an exemplary reactor manifold and disc of the reactor and mixing apparatus of the present invention.

Looking next at FIG. 2, there is depicted a cross-sectional view of an exemplary reactor manifold 15 and reactor 16. Rector manifold 15 includes a cylindrical opening 32 therein. Residing within cylindrical opening 32 is journal box 34 which houses journal bearings 36. Conduits 28, 30 connect to reactor manifold 15 at couplings 38, 40, respectively. There is a bore 42 through reactor manifold 15 providing a flow path between coupling 38 and annular channel 44. There is a bore 46 through reactor manifold 15 which extends from coupling 40 to align with bore 48. Bore 48 extends generally radially through journal box 34 such that a flow path from coupling 40 is provided through bore 46 and bore 48 to annular channel 50. Extending down from journal box 34 and formed integrally therewith is lower shaft housing 52 which is cylindrical. The inside surface of annular channel 50 is defined by the outside surface of shaft 18. The inside surface of annular channel 44 is defined by the outside cylindrical surface of lower shaft housing 52. A first annular flow path 54 extends from annular channel 50 down to the reactor 16. A second annular flow path 56 extends from annular channel 44 down to the reactor 16. First annular flow path 54 is defined by the outside surface of shaft 18 and the interior surface of lower shaft housing 52. Second annular flow path 56 is defined by the outside surface of lower shaft housing 52 in the inside surface of lower portion of a reactor manifold 15. There is a disc 60 connected to shaft 18 by means of machine bolt 62 such that disc 60 rotates with the rotation of shaft 18. A spacer 58 may reside between disc 60 and the lower end of shaft 18.

Figure 3:
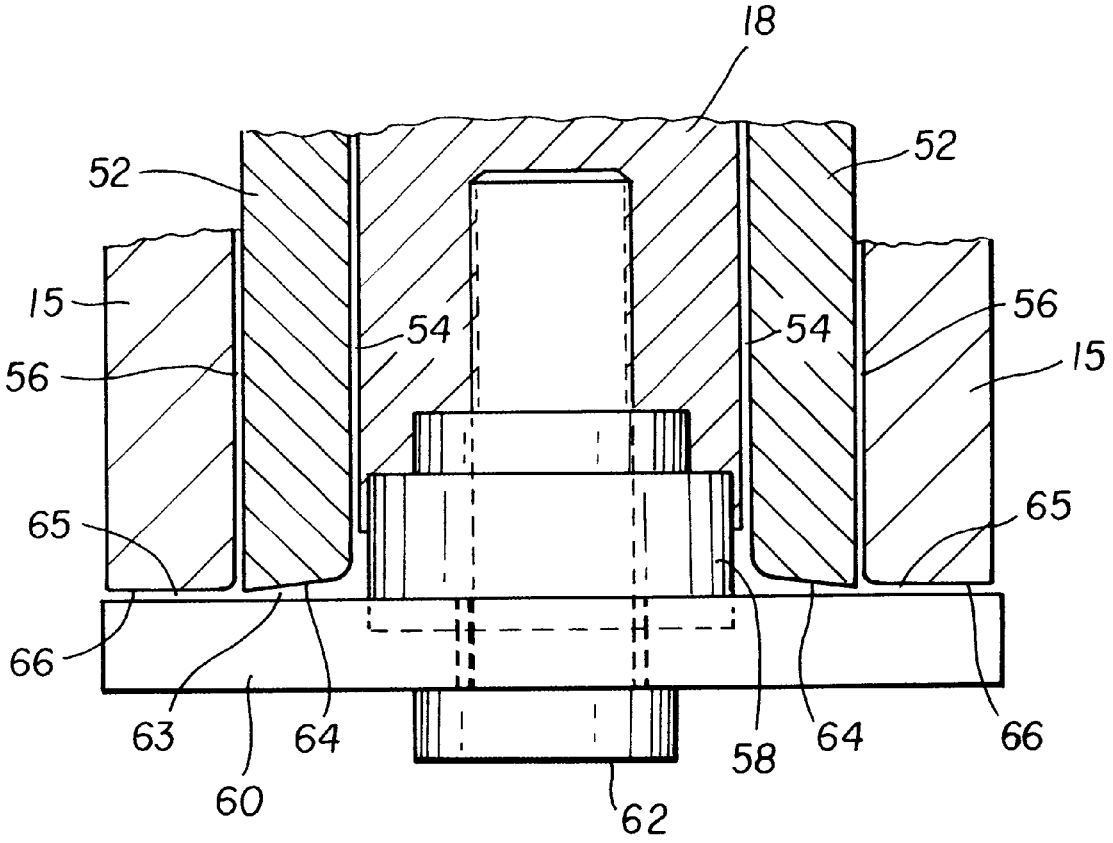
FIG. 3 is an enlarged cross-sectional view of disc and the lower portion of reactor manifold of FIG. 2.

Looking next at FIG. 3, there is shown a detailed cross-sectional view of disc 60 and the lower portion of reactor manifold 15. The reactant traveling down annular flow path 54 intercepts the top surface of disc 60 to thereby form a generally radial 360° flow in the gap 63 formed between the top surface of disc 60 and the bottom surface 64 of lower shaft housing 52. The top surface of disc 60 is "substantially planar." Although not preferred, the top surface of disc 60 may have a pattern of fine grooves therein to aid in the mixing and/or pumping functions of rotating disc 60. The groove(s) may be, for example, arranged as a single spiral line, as a pattern of a plurality of equally spaced, radially directed straight lines, or as a pattern of a plurality of equally spaced, arcuate segments. In addition, the top surface of disc 60 may be textured such that it has a rough surface in order to create turbulence and enhance mixing. The term "substantially planar" as used herein with regard to the top surface of disc 60 is intended to include smooth or non-grooved surfaces, textured or rough surfaces, and finely grooved surfaces. The reactant traveling down annular flow path 56 also intercepts the top surface of disc 60 to thereby form a generally radial 360° flow in the gap 65 formed between the top surface of disc 60 and the bottom surface 66 of reactor manifold 15. The reaction zone may be generally defined as gap 65 noting, however, that the reaction zone begins at that 360° interface where annular channel 56 and gap 63 converge such that the two reactants begin mixing with one another. Thus, geometrically, the reaction zone may be more accurately described as an annular volume. Use of a spacer 58 will aid in setting the thickness of that annular volume, that is, the thickness of gap 65. The reaction zone is characterized herein as "generally planar" to indicate that gap 65 is very narrow and that the top surface of disc 60 and the bottom surface 66 of reactor manifold 15 are parallel to one another. Also, the flow through the reaction zone is characterized as a "plug flow" and hence, the distribution of residence times for fluid elements is expected to be very narrow. It should be understood that due to the rotation of disc 60, the generally radial 360° flow of the two reactants begins to take a spiral path as opposed to truly radial. Thus, the term "generally radial" as used herein is intended to include both radial and spiraled or arcuate flow paths.

Disc 60 is depicted as having substantially the same outside diameter as the lower portion of reactor manifold 15. It should be understood that the diameter of disc 60 can be greater than the outside diameter of lower portion of reactor 15. However, the reaction zone would still end at the outside diameter of lower portion of reactor 15. Similarly, the reactor manifold 15 could be configured such that the lower portion thereof a larger diameter than disc 60. In such case, the reaction zone would end at the diameter of lower portion of reactor manifold 15. The outer edge of the reaction zone is that area where the reaction products begin to intermix with the contents of the main reactor vessel 12. Although not a preferred embodiment, when disc 60 has a larger diameter than the diameter of lower portion of reactor manifold 15, agitator blades can be attached to disc 60 such that through rotation of disc 60 the agitator blades attached thereto simultaneously mix the contents of the main reactor vessel 12.

The gap 65 between the bottom surface 66 and the top surface of disc 60 is kept to a dimension such that flow in the reaction zone has no recirculation zones when the disc 60 is rotated at a speed which for any particular device and reaction may be determined empirically. Similarly, the dimensions of the annular flow paths 54, 56 are chosen such that the backflow of material into the annular flow paths 54, 56 is prevented. The gap 63 between the bottom surface 64 of lower shaft housing 52 and the top surface of disc 60 is also of a dimension such that there are no recirculation zones therein and backflow from the reaction zone into gap 63 is prevented. The rotating disc 60 preferably extends beyond the reaction zone radially so that the effluent of the reaction zone mixes efficiently with the dispersion medium contained in the reaction vessel 12.

Although both annular flow paths 54, 56 are depicted as being substantially at right angles to the top surface of disc 60, it should be understood that the both annular flow paths 54, 56, and most particularly the outer annular flow path 56, may flare outwardly shortly before intercepting gaps 63, 65. This would be accomplished by providing the outer surface of lower shaft housing 52 proximate bottom surface 64 with a cone shape. The interior surface of reactor manifold 15 would also have a cone shape proximate to the bottom surface 66 thereof. A similar modification can also be made between the interior surface of lower shaft housing 52 proximate bottom surface 64 and the adjacent exterior surface of 18. Such a flared flow path between conar surfaces may be described as conar annulus. In this manner, one or both of the annular flow paths 54, 56 may be formed such that liquid exiting therefrom impinges on disc 60 at an angle from vertical (e.g. 30°). Flow would still be radially outward across the top surface of disc 60 and further, the liquid exiting such flared flow paths would already include a horizontal velocity component directed radially outward even before the liquid entered the gaps 63, 65.

Figure 4:
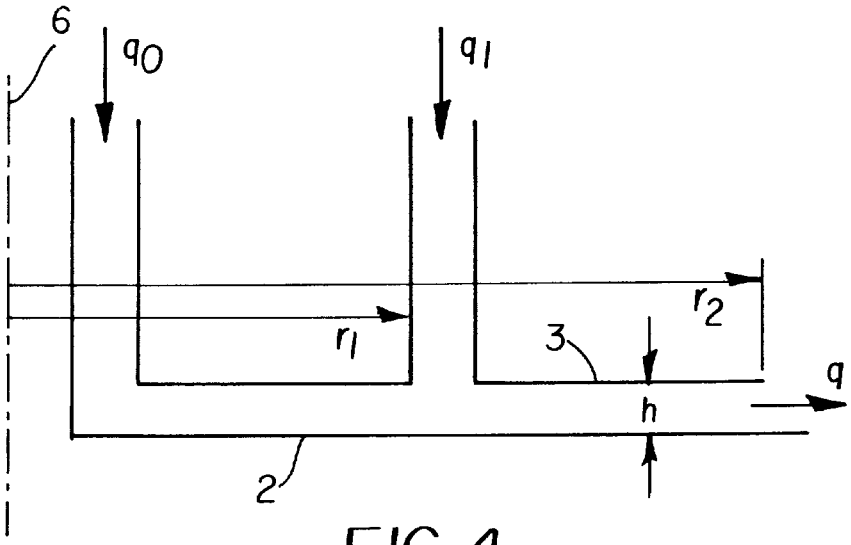
FIG. 4 is a schematic diagram illustrating critical parameters for residence time calculation in the reaction zone.

An important parameter in the operation of the present invention is the residence time, that being the time during which the silver and salt streams come into contact in the reaction zone before exiting into the reaction medium contained in the main reaction vessel 12. Assuming a plug flow velocity profile, the residence time, $\tau$, of the reacting fluid in the reaction zone is calculated via the mass balance equations below and stated with reference to FIG. 4, which is a schematic diagram of the reaction zone described with reference to FIG. 3:

$$\tau = \frac{2\pi}{q}\int_{r_1}^{r_2} hr\,dr$$

or $$\tau = \frac{h\pi}{q}[r_2^2 - r_1^2]$$

where $\pi$ is about 3.1412, q is the total combined flow rate of silver ($q_0$) and halide ($q_1$) salt containing streams flowing from annular flow paths 54, 56, that is, $q=q_0+q_1$, h is the dimension of gap 65, $r_1$ is the radial distance from the centerline of shaft 18 to the outer surface of the lower portion of reactor manifold 15, and $r_2$ is the radial distance from the centerline of shaft 18 to the outer edge of the reaction zone as defined herein. In addition to the definition provided above and as used herein to describe the reaction zone, the term "generally planar" may also be defined by the equations above. That is, if for the geometry of the device ($r_1$, $r_2$, and h) and the combined flow rate q, the equations above may be solved for the residence time $\tau$ such that $\tau \leqq 100$msec, then that reaction zone is "generally planar".

Example: To a stirred vessel at 68° C., containing 82 liters of distilled water, 43g of sodium chloride, and 4500 g of bone gelatin, was added 0.729 moles of a fine grained AgCl emulsion where the mean cubic edge length of the fine grains was about 0.14 $\mu$m. The vessel was stirred by a slanted marine propeller. A reactor as described with reference to FIG. 3, was employed to provide a reaction zone and intermix the reactants and subsequently deliver the reactants to the main stirred vessel shown in FIG. 1. The disk 60 was rotated at a rate of 5000 rpm. Next, a sodium chloride solution was added to the vessel to adjust its pCl to 1.05. Then 17g of 1,8-dihydroxy-3,6-dithiaoctane was added approximately 10 seconds before commencing the introduction of growth salt solutions. The growth salt solutions, 3.7 M silver nitrate and 3.8 M sodium chloride, were added to the reaction vessel through the reactor as six controlled double-jet pulses while maintaining pCl of the reaction mixture at 1.05. The sodium chloride solution also contained 2.6 wt % bone gelatin. The pulsed addition rate for silver nitrate solution was about 2 liters/min and the pulses were separated by hold periods. The residence time, $\tau$, in the reaction zone was 0.7 msec. During each hold period, the feed conduits were flushed with distilled water for 5 seconds. The six pulse-hold sequence had the following durations respectively: 0.75 min., 5 min., 0.75 min., 3 min., 3 min., 3 min., 3 min., 3 min., 3 min., 2 min., 1.5 min., 2 min.

Figure 5:
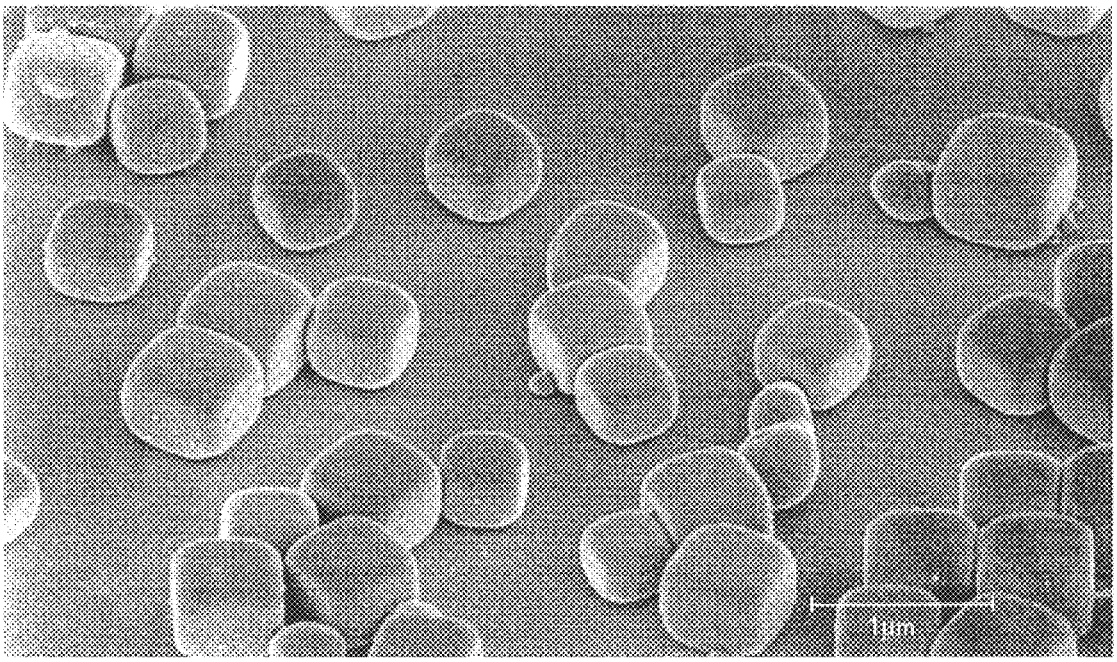
FIG. 5 is a Scanning Electron Microscope image of a silver halide emulsion made with the preferred embodiment of the present invention.

The resultant emulsion had a cubic edge length of 0.61 $\mu$m. A representative Scanning Electron Micrograph of the emulsion grains is shown in FIG. 5. For the apparatus used for this example, the height of gap 65 was 0.15 mm, the diameter of disc 60 was 60 mm and $r_1$=10 mm and $r_2$=28.5 mm.

From the foregoing, it will be seen that this invention is one well adapted to obtain all of the ends and objects hereinabove set forth together with other advantages which are apparent and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth and shown in the accompanying drawings is to be interpreted as illustrative and not in an illuminating sense.

PARTS LIST

10 mixing apparatus
12 reaction vessel
14 reactor support
15 reactor manifold
16 reactor
18 shaft
20 motor
22 shaft
24 agitating blade
26 liquid level
28 conduits
30 conduits
32 cylindrical opening
34 journal box
36 journal bearing
38 coupling
40 coupling
42 bore
44 annular channel
46 bore
48 bore
50 annular channel
52 lower shaft housing
54 first annular flow path
56 second annular flow path
58 spacer
60 disc
62 machine bolt
63 gap
64 bottom surface PARTS LIST cont.

65 gap
66 bottom surface

What is claimed is:

1. An apparatus for mixing at least two reactants comprising:

(a) a first annular flow path for delivering a fist reactant to a reaction zone;

(b) a second annular flow path for delivering a second reactant to the reaction zone, the first annular flow path being inside of and concentric to the second annular flow path, the first and second reactants intermixing in the reaction zone; and (c) a rotating disc having a surface defining one boundary of the reaction zone, flow of the first and second reactants through the reaction zone being generally radial and having a residence time in the reaction zone of not more than about 100 msec.

2. An apparatus as recited in claim 1 wherein:

the first and second flow paths are formed in a reactor manifold.

3. An apparatus as recited in claim 2 further comprising:

a main reaction vessel, the reactor manifold residing in the main rector vessel.

4. An apparatus as recited in claim 3 further comprising:

a driven agitator residing in the main reactor vessel to stir the contents thereof.

5. An apparatus as recited in claim 1 wherein:

the reaction zone is an annular volume defined at a top and a bottom thereof by a gap between the rotating disc and a surface of the reactor manifold.

6. An apparatus as recited in claim 5 wherein:

the first annular flow path intercepts the rotating disc at right angles thereto to create a 360° generally radially outward flowpath.

7. An apparatus as recited in claim 6 wherein:

the annular volume of the reaction zone is further defined a circle of intersection of the a 360° generally radially outward flowpath with the second annular flow path.

8. An apparatus as recited in claim 1 further comprising:

a drive for driving the disk such that the disc is rotated at a speed sufficient to at least overcome head losses to the flow of the first and second reactants through the reaction zone.

9. An apparatus as recited in claim 1 further comprising:

sources of first and second reactants, the first and second reactants are connected to the respective first and second annular flow paths for delivering a silver salt solution and a halide salt solution.

10. An apparatus as recited in claim 9 wherein:

one or both of the silver salt solution and the halide salt solution contains a peptizer.

11. An apparatus as recited in claim 9 further comprising:

a main reactor vessel for containing a reaction mixture including at least a dispersion medium and water.

* * * * *